US005819508A

United States Patent [19]

Kraft et al.

[11] Patent Number: 5,819,508

[45] **Date of Patent: *Oct. 13, 1998**

[54] DEVICE FOR REMOVING OR TWISTING OFF CAPS FROM VESSELS

[75] Inventors: Peter Kraft, Weilheim; Horst Menzler, Bernried; Hans Schels; Peter Wenzig, both of München, all of Germany

[73] Assignee: Boehringer Mannheim GmbH, Mannheim, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 627,620

[22] Filed: Apr. 4, 1996

[30] Foreign Application Priority Data

Apr. 6, 1995 [DE] Germany ..... 195 12 905.9

[51] Int. Cl.[6] ..... B67B 7/18; B67B 7/14

[52] U.S. Cl. ..... 53/492; 53/381.4

[58] Field of Search ..... 53/492, 381.4, 53/300, 331.5, 349, 353

[56] References Cited

U.S. PATENT DOCUMENTS

| | | | |
|---|---|---|---|
| 1,912,677 | 6/1933 | Williams | 53/300 |
| 2,940,229 | 6/1960 | Baker | 53/33.15 X |
| 3,377,775 | 4/1968 | Mattimoe et al. | 53/381.4 X |
| 3,589,103 | 6/1971 | Calvillo et al. | 53/381.4 |
| 3,803,795 | 4/1974 | Ouellette | 53/492 |
| 3,906,706 | 9/1975 | Conti | 53/331.5 |
| 3,987,535 | 10/1976 | Brown | 53/581.4 |
| 4,222,214 | 9/1980 | Schultz et al. | 53/331.5 X |
| 4,535,583 | 8/1985 | Tanaka et al. . | |
| 4,535,585 | 8/1985 | Gardos | 53/381.4 X |
| 4,696,144 | 9/1987 | Bankuty et al. | 53/331.5 |
| 4,876,926 | 10/1989 | Muszak . | |
| 4,919,014 | 4/1990 | Chen et al. . | |
| 4,982,553 | 1/1991 | Itoh | 53/381.4 X |
| 5,408,801 | 4/1995 | Molinaro | 53/300 |

FOREIGN PATENT DOCUMENTS

| | | |
|---|---|---|
| 0 497 112A1 | 8/1992 | European Pat. Off. . |
| 0 639 530A1 | 2/1995 | European Pat. Off. . |
| 2053747 | 4/1971 | France . |
| 28 56 432A1 | 7/1980 | Germany . |
| U-94 03 243.2 | 9/1994 | Germany . |
| 58-34352 | 7/1983 | Japan . |
| 2-27235 | 6/1990 | Japan . |
| 6-8995 | 1/1994 | Japan . |
| 1245081 | 9/1971 | United Kingdom . |
| 2 010 789 | 7/1979 | United Kingdom . |

*Primary Examiner*—Horace M. Culver
*Attorney, Agent, or Firm*—Nikaido, Marmelstein Murray & Oram LLP

[57] ABSTRACT

Device for pulling out or twisting off caps from vessels, wherein the vessel is held, and the cap is removed by means of a cap-holding device; the cap-holding device executes both a linear movement in direction of the vessel axis as well as a rotating movement around the vessel axis. The cap-holding device advantageously has several clamping jaws that are pressed against the circumference of the cap.

27 Claims, 8 Drawing Sheets

23
20
24
22
21
13
10
11
12
X 55
71
71
75
70
21
10
56
72
57
74
73

DEVICE FOR REMOVING OR TWISTING OFF CAPS FROM VESSELS

The present invention addresses a device for pulling out or twisting off caps from vessels, particularly sample vessels comprising

- a vessel holder in which the vessel is held such that the cap of the vessel is freely accessible,
- a cap-holding device with holding elements to hold the cap,
- a device for moving the cap-holding device essentially parallel to the axis of the vessel and rotate the cap-holding device around said vessel axis.

Devices for removing caps from vessels are used in particular in the field of clinical analysis where numerous sample vessels are used, which are closed with stoppers or caps which must be removed prior to analysis.

Prior art already knows automated devices to remove stoppers from sample vessels. U.S. Pat. No. 5,340,544, for example, describes an apparatus to remove rubber stoppers from sample vessels. This is accomplished in that leave springs laterally approach the rubber stoppers to push them out of the vessel. European patent applications EP-A-0 487 492 and EP-A-0 487 493 describe devices that are based on a similar principle. In the devices described in these applications, a needle is laterally introduced into the rubber stopper and moved along a guiding element such that the stopper is pushed out of the vessel. European patent EP-B-0 264 456 also describes an apparatus for pulling stoppers out of sample vessels. This apparatus features a holding device for the sample vessels, and a mechanism where the two stoppers are embraced by two opposite clamping jaws. Said clamping jaws are then contracted while spikes are pushed into the rubbers in order to improve the holding procedure. The stopper is removed in that the device together with the clamping jaws is being moved away from the sample vessel.

It is a draw-back of the devices known in prior art that only stoppers can be removed, however, not screw caps. This restriction to stoppers means that not all types of the sample vessels used in the practice can be processed in such a manner.

It was, hence, an object of the invention to propose a device which allows removing stoppers as well as screw caps. It was also an object of the invention to propose a device which can be used to remove caps from any desired sample vessel used in the practice.

It was found that this object can be accomplished by a device for pullig out or twisting off caps from vessels which has

- at least one vessel holder to hold a vessel such that the cap of the vessel is freely accessible,
- a cap-holding device with holding elements to hold the cap, and
- a device for moving the cap-holding device essentially parallel to the axis of the vessel and to rotate the cap-holding device around said axis.

In the vessel holder, a sample vessel is held such that the removal of a cap is possible. A prerequisite therefore is that the vessel holder acts as a counterpart to the forces that are exerted when pulling out or twisting off caps. The vessel-holding device must, hence, be configured such that it reduces to a largest possible extent both rotating movements and linear movements of the vessels. The sample vessels that are commonly used are reagent tubes made of glass or plastic. The vessel holder must, hence, be configured such that it acts as a holding device without exerting too great a pressure onto a sample vessel thus preventing the destruction of the vessel. A suitable device for holding reagent vessels is described for example in EP-B-0 264 456. In accordance with the invention, a vessel holder that is particularly suitable is one where the reagent vessels are held between clamping jaws made of a relatively elastic material such as rubber. The clamping jaws in turn are, via adjusting elements, attached to an axis where it can be tilted with respect to the axis of the vessel. It has proven to be particularly simple when the adjusting elements can be moved away from or towards each other via a spindle drive in order to thus open or close the vessel holder. Such a spindle drive can be advantageously driven via one single motor to move one pair of adjusting elements, provided that the spindle drive for both adjusting elements is located on a single threaded rod where one segment has a right-handed thread and the other segment a left-handed thread.

The described vessel holders can be operated together with racks for sample vessels. On racks that are commonly used in the practice, several reagent vessels are provided in a linear successive arrangement. Such a rack can be operated together with a vessel holder in that the rack is pushed between the clamping jaws of the vessel holder. If the rack is configured such that the sample vessels are accessible from the side, sample vessels can be held by the clamping jaws without pulling out the sample vessel to remove the cap.

In a particularly preferred embodiment, the sample rack is placed on a conveyor belt where the individual vessels are successively passed underneath a cap-holding device. A vessel located underneath the cap-holding device is lifted by a grab, and the cap of the device is inserted into the cap-holding device. Experience has shown that it is expedient to have a grab with a relatively simple mechanical structure, and to provide a separate device to hold the vessel during the twisting. If an additional grab is provided, this vessel-holding device can be stationary.

It is also possible to employ the rotors for sample vessels used in some instruments, where the sample vessels are arranged in a circle together with the above described vessel holders. A prerequisite is that the vessels can be accessed from the side. It is, of course, also possible to use a robot arm to remove the sample vessels from any desired rack and place them into the vessel holder.

The invention advantageously proposes a vessel holder which consists of two vessel holders that are commonly attached to one rotating arm. One of these two vessel holders is always in a position that is accessible for the cap-holding device, usually underneath that cap-holding device. The second vessel holder is then in a position where closed sample vessels can be loaded. Once the vessel located in the first position, has been opened, another closed vessel is in the second position; now the rotating arm performs a rotation, where the two positions are exchanged. The still closed vessel can be opened and the already opened vessel is transported away for further processing. The here described device is particularly suitable for incorporation in a conveying system where the sample vessels individually pass numerous stations where, for example, labels are attached, and pipetting, diluting or centrifugation steps are carried out.

If the intention is to reduce the time requirement necessary to remove the caps from the vessels, it is expedient to select an arrangement wherethe vessels are placed in racks and the racks are passed underneath the cap receiver. The vessels to be opened can be only merely lifted; it is not necessary to completely remove the vessels from the rack.

A cap-holding device is equipped with elements to hold the caps. It is possible, for example, to use a cap-holding device as the one described in FIGS. 11 to 15 of European patent EP-B-0 264 456 or a similar device. The invention, however, comprises a novel cap-holding device that has proven to be particularly advantageous for this special application. The cap-holding device in accordance with the invention features a multitude of gripping jaws, preferably 4 to 8 and more preferably 6. The gripping jaws are arranged around a center and essentially on one plane. A drive unit allows to move the gripping jaws from a first position into a second position; in the first position there is a space left between the gripping jaws that is sufficiently large to receive the respective cap that has to be removed. In order to handle a cap diameter of 11 to 19 mm that is commonly used in clinical practice, a distance of greater than 19 mm between the gripping jaws has proven to be suitable. In the second position, the gripping jaws have approached one another such that the removed cap is held between the jaws. From the object of the invention, to handle different types of caps, it can be concluded that the second position is not a fixed position but a variable on which can be adjusted to match the respective cap. For reasons of simplicity, the first position is preferably selected such that all caps commonly known in the practice fit between the two gripping jaws. The drive unit used to move the gripping jaws can be a pressurized cylinder or a spindle drive. In accordance with the invention, however, a drive unit was found which simultaneously moves all gripping jaws in a simple manner. This drive unit comprises two plates in a parallel arrangement which are rotated in counter sense perpendicular to their planes with the aid of a plate drive. The two plates preferably have circular recesses in the area of their axes of rotation. A connecting axis is used to rotatably connect each of the gripping jaws with the first plate; each such element can then be rotated around its connecting axis with the first plate with the aid of pins that are attached to the second plate. The pins of the second plate preferable engage recesses in the gripping jaws which serve as guiding rails. The guiding rails and the connecting axis are arranged such that the tips of the clamping jaws move away from the center to receive the cap when the plates are rotated in counter sense such that the connecting axis on the first plate and the pins of the second plate move away from one another. Owing to this counter sense rotation, the gripping jaws can move toward a common center to hold a cap that is now located between the two jaws. It was found to be advantageous if the edges and/or surfaces of the gripping jaws which press against the cap, are configured as toothed edges or surfaces. It has proven to be particularly advantageous if the gripping jaws are provided with needles or spikes which at least partially penetrate the cap when the latter is held.

The cap holding device is preferably located on a device for moving the cap-holding device essentially parallel to the axis of the vessel and to perform a rotation of said device around the axis of the vessel. This moving device can be a robot arm, for example, to execute the corresponding movements with the cap-holding device. Moreover, it is conceivable that the moving device is configured as a rigid toothed bar along which the cap-holding device is moved up and down with the aid of a gear wheel drive while a separate motor is used to rotate the cap-holding device. The invention has found a particularly simple solution for this moving device wherein one single motor drives a screw located at the cap-holding device. This screw is located in a nut such that, when the motor rotates the cap-holding device, it executes a rotation around the axis of the screw and also a linear movement in direction towards the axis of the screw. For the caps used in the practice, it has proven to be particularly advantageous if the rotation of the cap-holding device is one of 400°, and if the screw is selected such that the advance of the cap-holding device during this rotation is 9 mm. Good results were also obtained with an angle of rotation for the vessel holder of greater than 300° and with an advance of the vessel holder of at least 5 mm.

The aforementioned embodiment could further be improved by rotatably mounting the nut which the screw of the cap-holding device engages, and by providing a pin which engages in a toothed segment on the outer edge of the nut and which can be arrested in position. With this arrangement it is possible to use the cap-holding device not only for removing caps from vessels but also to rotate the vessels, e.g. in order to read a barcode.

In order to lower the cap-holding device on the cap, it may be necessary that the cap holder has to travel relatively large distances in direction of the axis of the vessel. In this case, the invention proposes that the nut which the screw of the cap-holding device engages also moves in direction toward the axis of the vessel.

The invention also addresses a method for opening vessels, particularly sample vessels, by pulling out or twisting off caps, wherein a vessel is held in a vessel holder, a cap-holding device holds the cap of the vessel, and the cap-holding device is moved with the aid of the device such that it removes the cap from the vessel by executing a linear and rotating movement.

In the aforementioned method, it is possible to use the already described apparatus in accordance with the invention. In order to implement the method, a vessel must be located in a vessel holder such that the upper end where the cap is located is accessible for the cap-holding device; i.e. the cap must project out of the vessel holder, and the circumferential area around the cap must be free of interfering components. In order to open the cap, the cap-holding device is first lowered onto the cap or the cap is introduced into the cap-holding device such that the cap is located in the center between the two gripping jaws. Since the apparatus of the invention is designed to process a multitude of different types of sample vessels and caps, it should also feature a device which controls the lowering of the cap-holding device or the lifting of the vessel in such a manner that the cap in question can be retained by the gripping jaws at any time. A mechanical detection mechanism for the upper edge of the stoppers has been described, for example, in European patent application EP-A 0 467 470. European patent application EP-A-0 467 302, however, describes an optoelectronic system to scan sample vessels. The latter system can be advantageously used with this invention since it recognizes not only the upper edge of the stopper but also the dimensions of the stopper; the cap-holding device can then be controlled such that the cap is held in a well-suited position. The disclosures of patent applications EP-A 0 467 470 and EP-A-0 467 302 are therefore included in this application.

In accordance with the invention, a particularly simple method was found to suitably position vessels in order to remove caps. This is accomplished in that a grab with clamping jaws first holds the vessel, then the clamping jaws are slightly opened and the grab is moved upwardly; the gripping jaws now reach a position underneath the edge of the vessel opening or underneath the cap. The grab now introduces the cap into the cap-holding device in such a manner that the holding device is located only a few millimeters above the clamping jaws of the grab. Experiments have shown that this is a very simple and efficient method to move the caps of the cap-holding device into a suitable position without requiring complex position recognition systems.

If, however, the device of the invention is used to process sample vessels where a multitude of different operations is carried out, the scanning of the sample vessel can be carried out at a location that is remote from the device in accordance with the invention, since the scanning of the sample vessels is usually one of the first steps. The data received in the scanning procedures is used for numerous different operating steps during the processing.

The suitable control of the device for moving the cap-holding device can advantageously be accomplished with a microprocessor. Said microprocessor processes data received during the scanning of the sample vessels and controls the individual movements such as the lowering, rotating, and lifting of the cap-holding device. When using such a microprocessor, the types of sample vessels and caps commonly used in the practice can be advantageously stored; this allows identification of the sample vessel and the cap with relatively simple optical and mechanical scanning devices; characteristic data that has not been determined during the scanning, such as diameter of the cap and elasticity of the cap, can be read off a table.

The method of the invention for removing caps can be divided into the following steps:

- The moving device moves the cap-holding device into an initial position, and the presence of the cap-holding device in this position is detected via a light barrier.
- In the cap-holding device, the first and second plates are rotated with respect to each other such that the clamping jaw move away from each other in order to open the cap-holding device to receive a cap.
- A closed vessel is introduced into the vessel holder and held therein.
- The moving device lowers the cap-holding device onto the cap of the vessel or the cap is introduced into the cap-holding device.
- Unless the cap-holding device is already in a suitable position with respect to the cap, it is now moved into a position where the clamping jaw are on one level with the cap or the cap in turn is correspondingly lifted.
- The first and second plates in the cap-holding device are rotated with respect to each other in such manner that the clamping jaw move towards one another in order to hold the cap.
- The moving device rotates the cap-holding device and moves it upwardly.
- The moving device moves the cap-holding device back into its initial position.
- The plates in the cap-holding device are rotated with respect to one another such that the clamping jaw release the cap.

The invention is now explained in greater detail with reference to the drawing.

FIG. 1 is a lateral view of the cap holding device and the moving device.

FIG. 2A is a cross section of the cap holding device in its open position. FIG. 2B is a cross section of the cap holding device in its closed position. FIG. 2C is a view of an individual gripping jaw.

Figure 1:
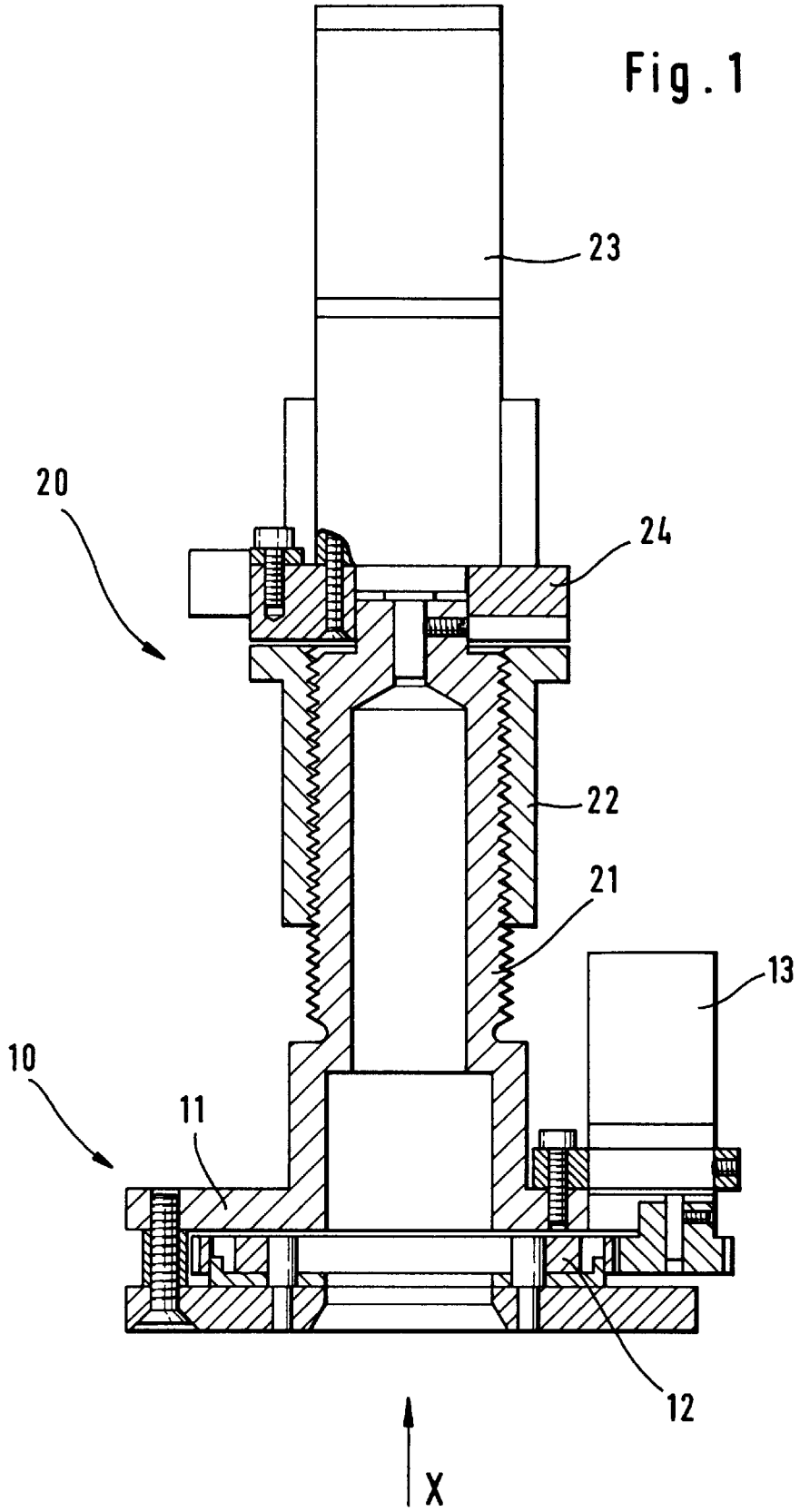

FIG. 1. shows the cap holding device (10) and the moving device (20) in a lateral view. The housing of the cap holding device forms the first plate (11) of the cap holding device (10); the second plate (12) is located in the interior of the housing, and has the form of a circular ring with an outer toothed ring. A rotation of the first plate (11) and the second plate (12) is accomplished with the aid of a drive motor (13) which is mounted on the first plate (11); the shaft of said motor is provided with a toothed wheel which engages the teeth of the second plate (12).

A screw (21) which engages a nut (22) is located on the top of the cap holding device (10). Screw (21) is rigidly connected to the axis of a second drive motor (23) which rotates the screw. Said drive motor (23) has a catch (24) to prevent a rotation of the motor housing, but allows an up and down movement of the motor. When the drive motor (23) rotates, the arrangement of cap holding device (10), screw (21), and drive motor (23) moves parallel to the axis of rotation while the nut (22) remains fixed in its position. In order to move the entire arrangement of vessel holder (10) and movement device (20) parallel to the axis of rotation, the invention proposes to move the nut (22) via a drive, e.g. via a rack drive, to allow rapid movement of the arrangement to cover larger distances.

FIG. 2 is a cross section of the cap holding device in accordance with the invention from its bottom (view X). In this representation, it can be seen that the gripping jaws (14) are rotatably connected to the first plate (11) via an axis (15) which is attached to their ends. The gripping jaws (14) have a recess (16) to guide pins (17) which in turn are rigidly mounted on the second plate (12).

Figure 2A:
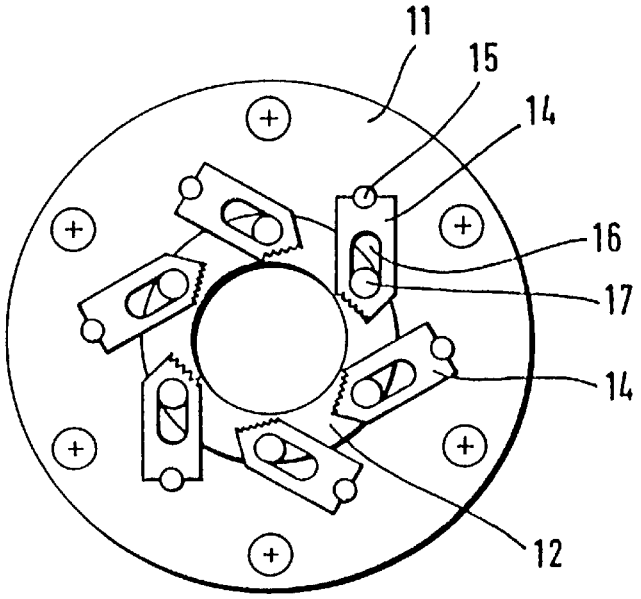

FIG. 2A shows the cap holding device in its open position from which it is closed by clock-wise rotating the second plate (12).

Figure 2B:
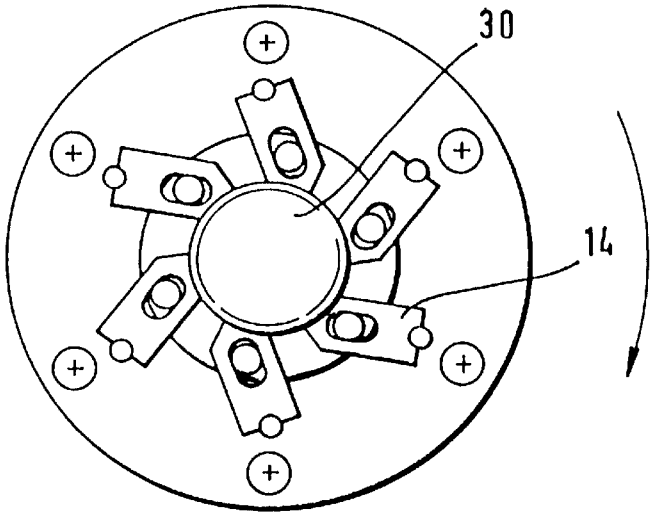

FIG. 2B shows the cap holder in a position where the gripping jaws (14) hold a cap (30).

Figure 2C:
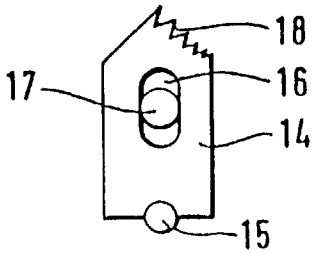

FIG. 2C shows an individual gripping jaw (14) with the recess (16) and the toothed segment (18) at its arrow-like tip. At the tip of the gripping jaw, the individual teeth (18) are spaced apart at a relatively large distance. The distance between the individual teeth and, hence, the size of the individual teeth decreases with an increasing distance to the tip. Such a configuration of the toothed segment has proven to be particularly advantageous when the vessel holder is used to hold relatively small as well as relatively large caps.

Figure 3:
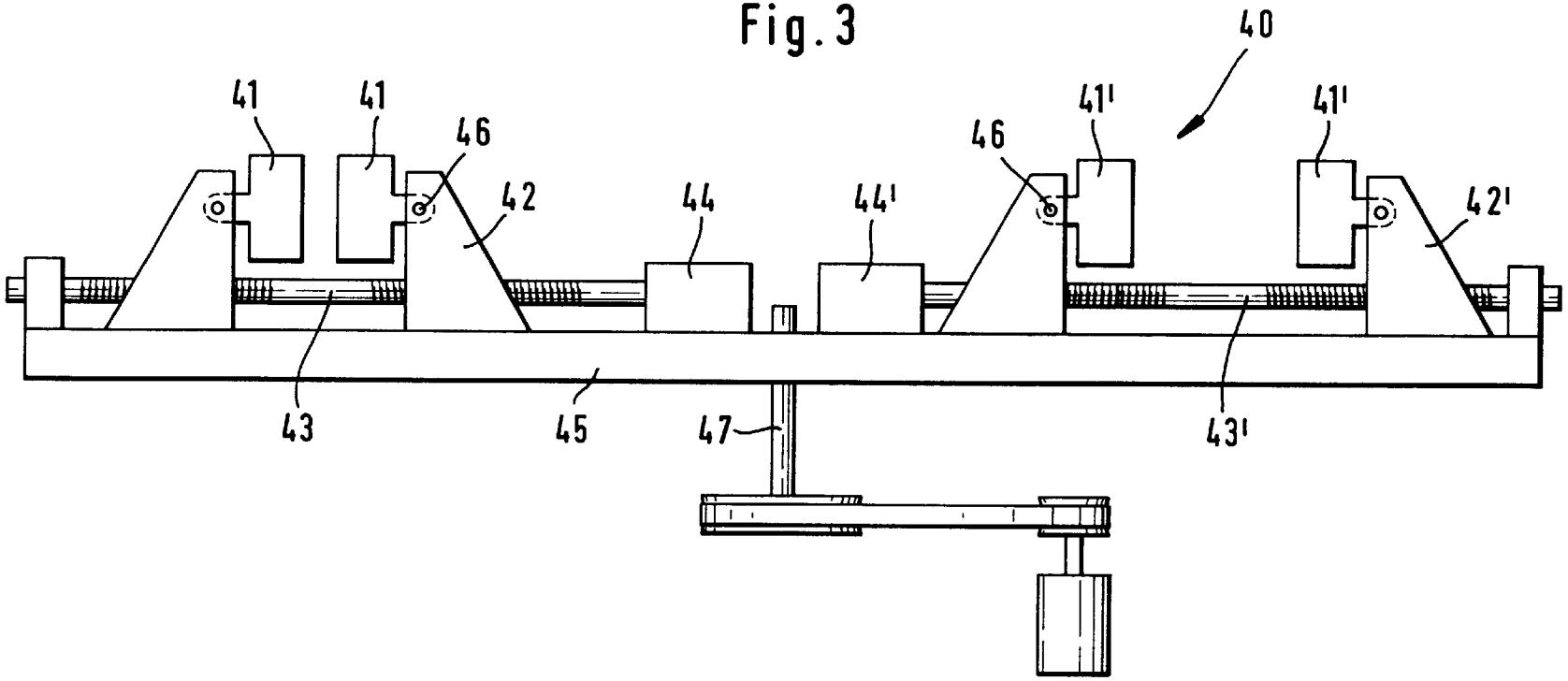
FIG. 3 shows the vessel holder.

FIG. 3 shows an arrangement (40) of two vessel holders which are both mounted on a common axis (45). Each vessel holder has two clamping jaws (41, 41') which are connected to the adjusting elements (42, 42') via an axis (46). By mounting the clamping jaws(41) to an axis (46), the jaws can be tilted thus allowing a more effective grip of the sample vessels. The adjusting elements (42, 42') are slideably located on the rotating arm (45) and are equipped with threads in which a spindle (43, 43') is located. Each spindle (43, 43') has both a left-hand and a right-hand thread. The spindles are driven via a motor (44 and 44') in order to move the clamping jaws (41, 41') towards or away from each other. The entire arrangement of two vessel holders can be swung via a rotating arm that is rotatably mounted on an axis (47).

With the device shown in FIG. 3 it is, hence, possible to hold a closed sample vessel in one of the vessel holders in order to open said vessel and, at the same or a different time to start processing a second still closed sample vessel in the second vessel holder. Once the vessel held in the first vessel holder has been opened, the rotating arm (45) is rotated around axis (47) such that the two vessel holders exchange positions. The now opened vessel can be removed from the vessel holder and at the same or a different time, the still closed vessel can be opened.

Figure 4:
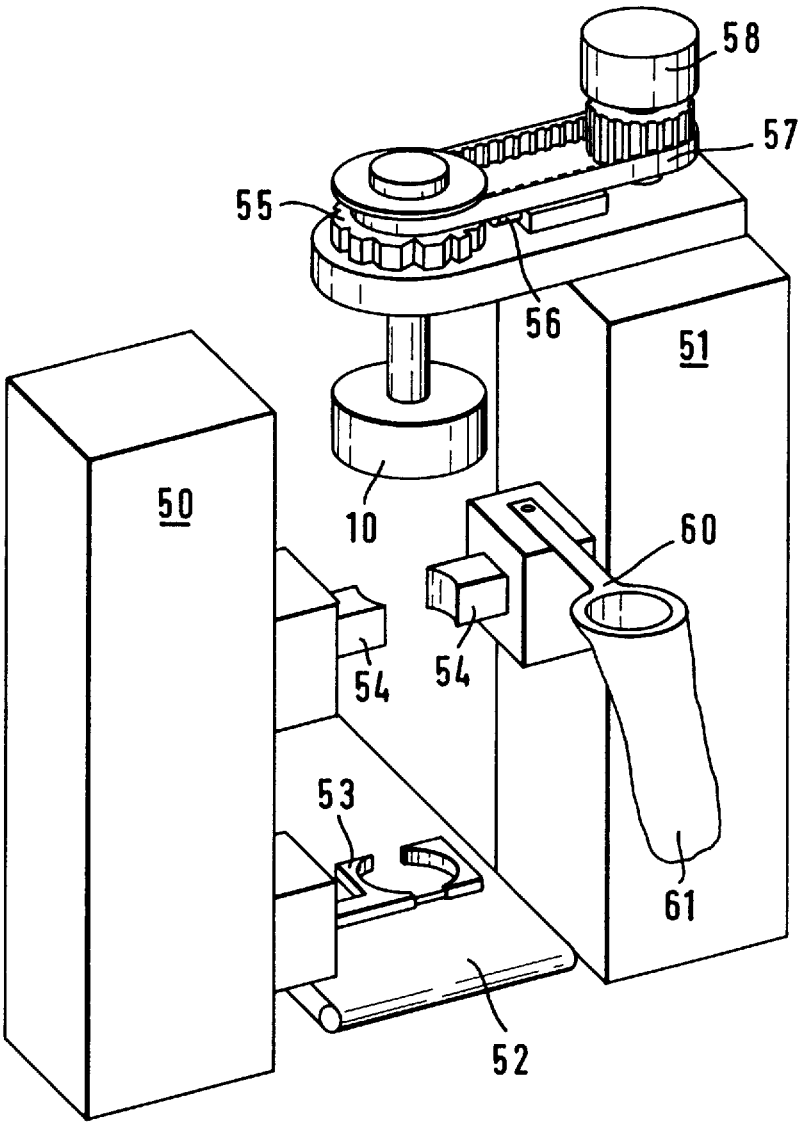
FIG. 4 is a perspective representation of a second embodiment.

FIG. 4 is a diagrammatic perspective view of another embodiment to increase the throughput of vessels. Individual components of the second embodiment are shown separately in FIGS. 5–8.

The device of FIG. 4 has a left and a right leg (55, 51). Between these legs, a conveyer belt (52) passes to convey racks with sample vessels. The belt is arranged such that the vessels in the rack are successively passed underneath the vessel holder. The conveyer belt (52) can be controlled such that it stops when a sample vessel is located underneath the cap holding device.

A grab (53) to remove vessels from a rack or to lift a vessel in the rack is located at the left leg (50). The grab (53) is, for example, located on a spindle to be moved up and down.

In order to feed a cap to the cap holding device, grab (53) moves upwardly such that it comes to a rest above the clamping jaws (54) of the vessel holder. In this position, elements (54) hold the vessel. The height to which grab (53) lifts the vessel is selected such that the cap holding device (10) is able to hold the cap. An advantage of this embodiment is that the relatively heavy cap holding device must not be moved over larger distances toward a cap. By avoiding the acceleration of larger masses, it was possible to reduce the time required to execute the cycles in the system in question.

FIG. 4 is a diagrammatic representation of another cap holding device (10) with a rotatably mounted nut (55); on its circumference, said nut is provided with indentations. These indentations are engaged by a tappet (56) to prevent a rotation of nut (55). In this embodiment, the cap holding device (10) is, via a toothed belt (57), driven by a motor (58)

FIG. 4 also shows a receptacle for caps that were twisted off; said receptacle has a lever (60) with an elastic tube (61).

Figure 5:
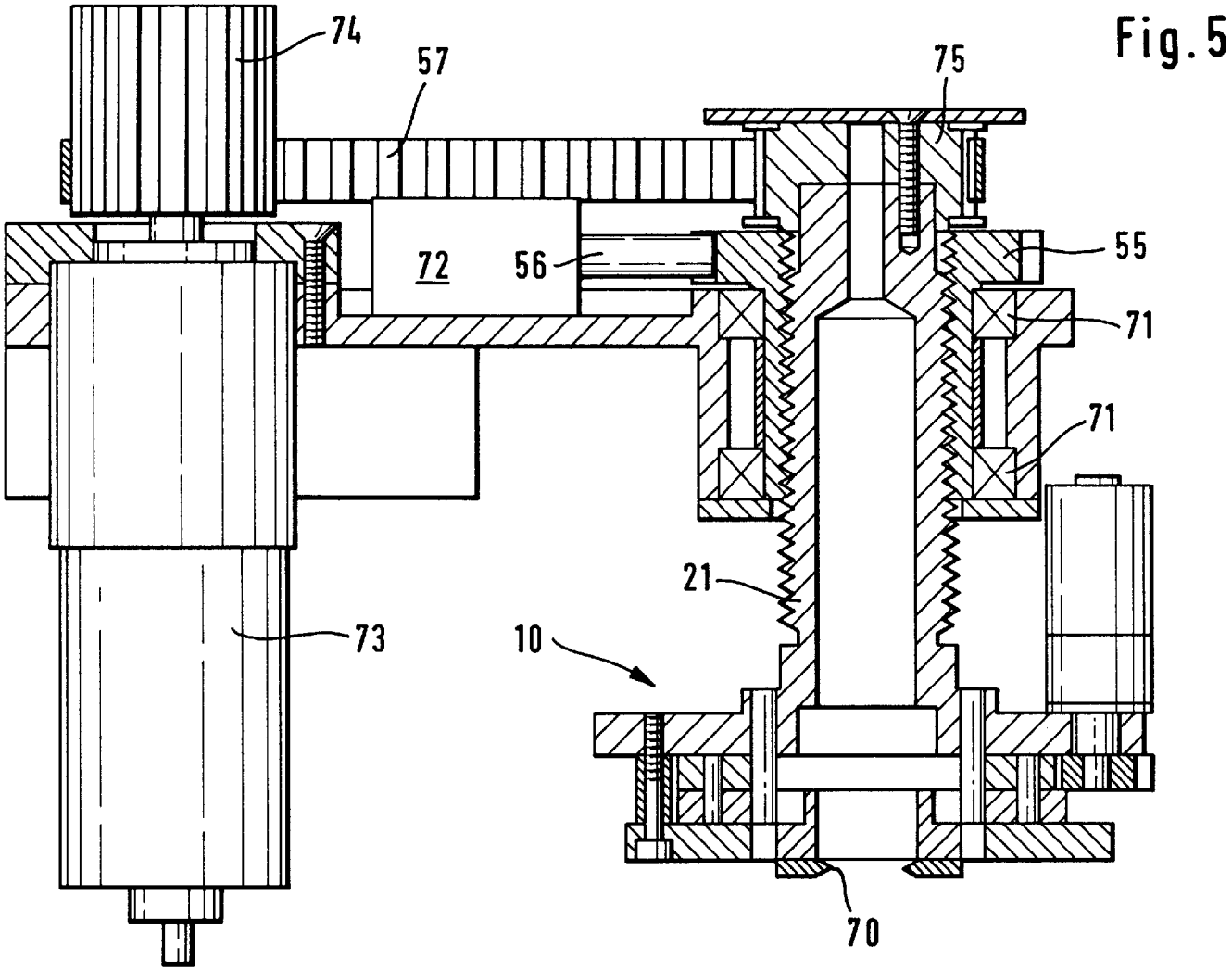
FIG. 5 is another embodiment of the cap holding device.

FIG. 5 shows a variant of the cap holding and moving devices shown in FIG. 1. The region of the cap holding device (10) has not undergone essential modifications; the description of FIG. 1, hence, still applies. With respect to the cap holding device (10), however, it can be seen that the clamping jaws are provided with spikes (70) which enter at least partially the cap material when holding such caps.

In this and in the first embodiment, said cap holding device (10) is located on a threaded rod and/or screw (21). As opposed to the first embodiment, the nut (55) is rotatably located in ball bearings (71). In its upper part, the circumference of the nut (55) is provided with indentations, e.g. corresponding to the two segments of a toothed wheel, such that tappet (56) engages these indentations. Tappet (56) is moved via a lifting magnet (72). In its resting position, the tappet (56) is largely inside the lifting magnet (72) and it does not engage the indentations of nut (55). When magnet (72) is activated, tappet (56) engages the indentation of nut (55).

Threaded rod (21) to which the holding device (10) is mounted, is driven via a motor (73) with the aid of a toothed belt (57). Said toothed belt (57) runs via a first toothed wheel (74) located on the axis of the motor (73), and via a second toothed wheel (75) which is rigidly connected to the first threaded rod (21).

Provided nut (55) is not arrested in its position and a threaded rod (21) is driven via motor (73), the cap receiver (10) is rotated without executing a linear movement. This can be advantageously used when the entire sample vessel is to be rotated prior to removing the cap, e.g. to read off a bar-code on the vessel or to determine the filling level. If, however, nut (55) prevents a movement of tappet (56), the rotation of the a threaded rod (21) is partially converted into a linear movement, and the cap holding device (10) executes both a linear and rotating movement. The advantages of removing caps by executing this type of movement have already been described in greater detail in connection with the first embodiment.

Figure 6A:
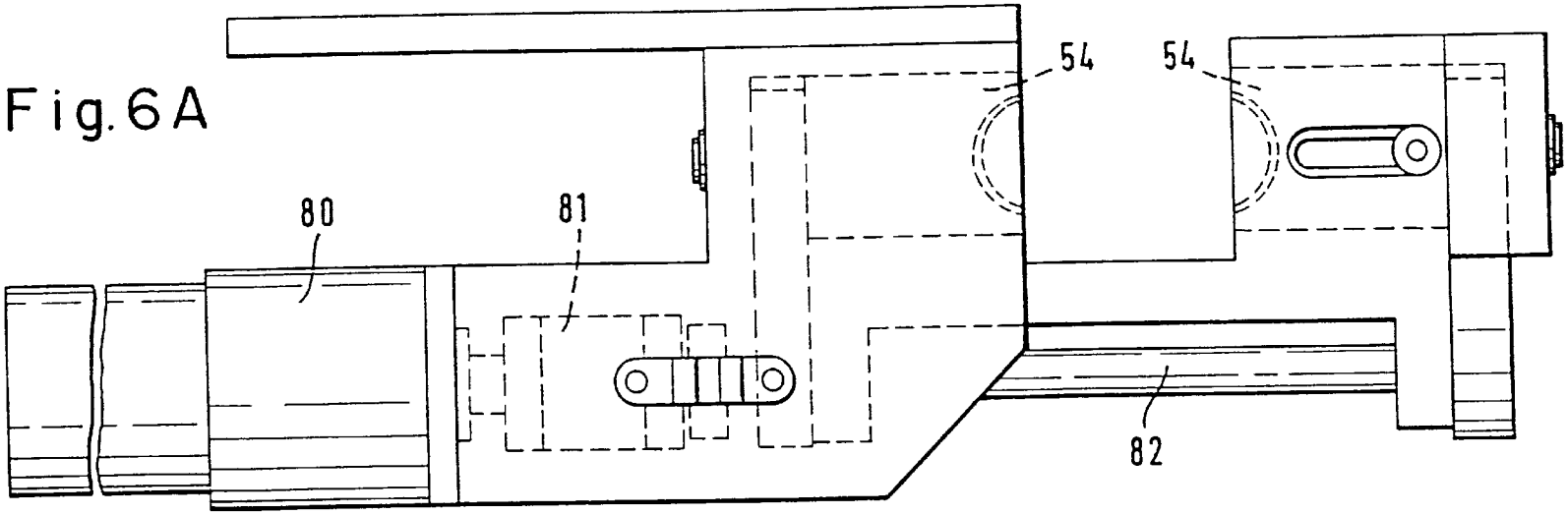
FIG. 6A is a top plan view of the vessel holder.
Figure 6B:
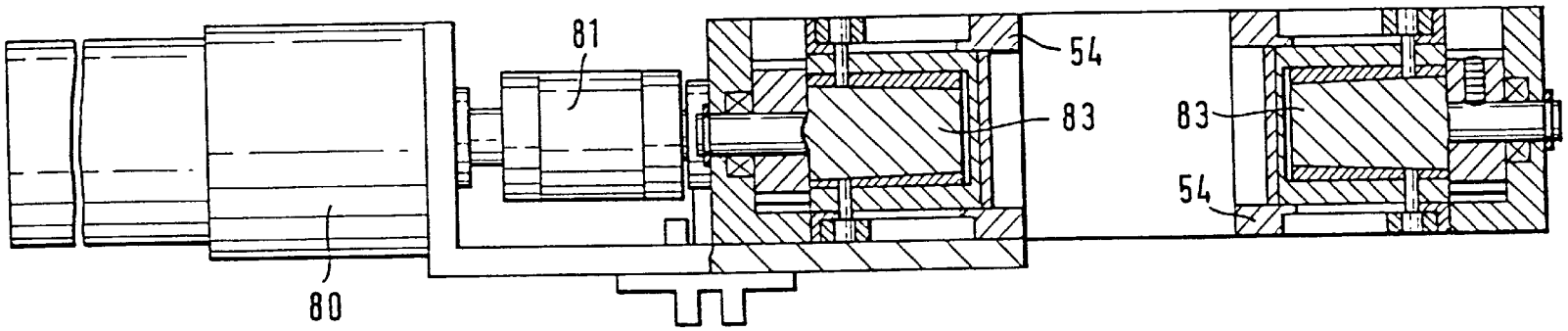
FIG. 6B is a side cross section of the vessel holder.

FIG. 6 shows an improved embodiment of the vessel holder. It has been found that it is imperative for the proper functioning of the vessel holder that the position of the vessel axis be exactly defined for each operating cycle and to avoid any displacement between individual cycles. It is, hence, advantageous to use a single motor (80) to drive the vessel holder which transfers its rotating movement on both vessel clamping jaws (54). A damping element (81) which serves to avoid heavy mechanical stress on the vessels when the vessel holder is closed is provided on the axis of motor (80). This damping element (81) is made of a flexible material, usually plastic, which is located between two metal disks; said disks are rigidly connected with the respective part of the axis. If the vessel is already tightly held by the clamping jaws, while the movement of the motor is continued due to motor's inert behavior or a delay of the detection, the elastic material of the damping element is compressed and a destruction of the vessel is thus prevented. The damping element (81) is followed by a drive axis (82) to which two toothed wheels are mounted, said toothed wheels in turn drive a toothed belt. In the area of the vessel clamping jaws (54), these toothed wheels drive toothed belts which are connected to a cone (83) whose outer circumference is provided with a pin. The vessel clamping jaws (54) are each equipped with a cylinder to surround the cones (83); at its inner side, the cylinder has a groove into which the pin of the cone can engage. The vessel clamping jaws (54) are mounted such that they can only execute a linear movement, but not a rotating movement. When the cone (83) is rotated, the interaction of pin and groove allows a movement of the vessel clamping jaws (54) towards or away from each other depending on the sense of rotation of the cone.

Figure 7:
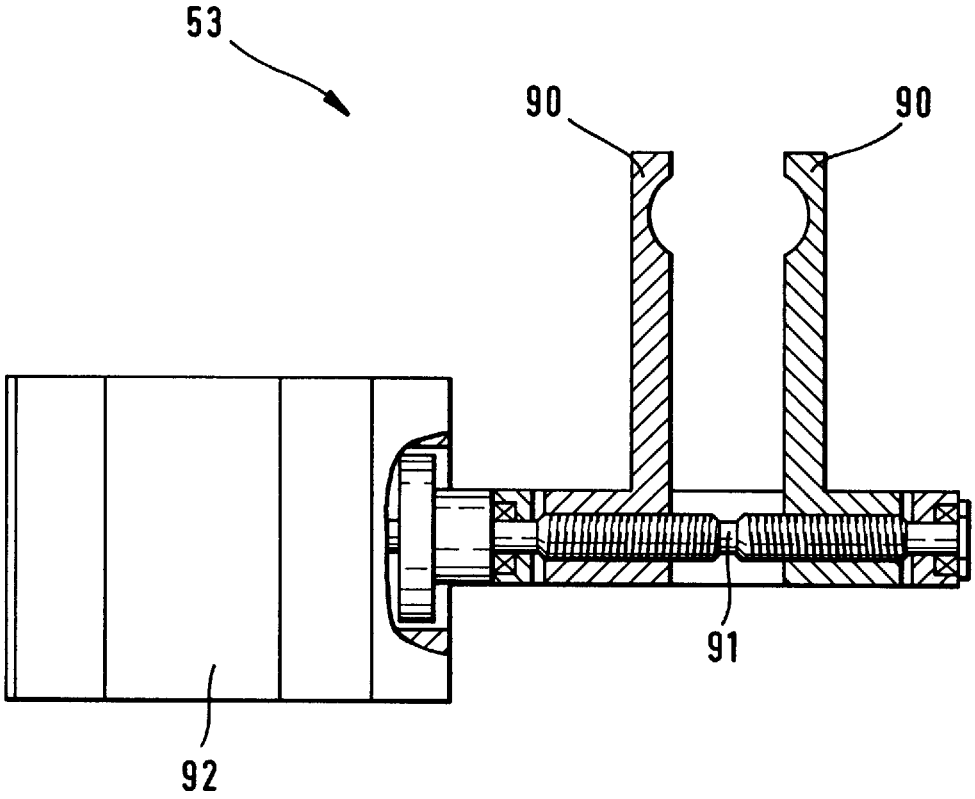
FIG. 7 shows a gripping arm

FIG. 7 shows a grab (53) of a relatively simple design. Each of the two gripping jaws (90) has a thread which runs on a threaded rod (91); said a threaded rod is provided with two threads of opposite orientation. For a detailed description, refer to FIG. 3. The a threaded rod (91) is connected with the axis of a motor (92). By rotating the axis of the motor, the gripping jaws (90) are moved towards or away from each other depending on the sense of rotation. In order to avoid a destruction of the vessels, it is possible to provide a damping element (81) between the axis of the motor and a threaded rod (91).

The function of the grab is to take a vessel and feed it to the cap holding device in a suitable manner. Experience has shown it to be advantageous if the grab (53) first tightly embraces a vessel with the aid of its gripping jaws (90) and then slightly releases its grip by a counter-directed movement of the motor. The vessel can now be shifted along the axis of the vessel between the gripping jaws (90) while a lateral displacement is avoided. If the grab (53) is moved upwardly, the vessel slides through the gripping jaws (90) along its longitudinal axis until the edge of the vessel or the cap comes to a rest on the gripping jaws (90). Based on the position of the gripping jaws which is known to the device, it is now possible to determine the position of the cap with sufficient accuracy. A separate detection of the cap is, hence, no longer required.

Figure 8A:
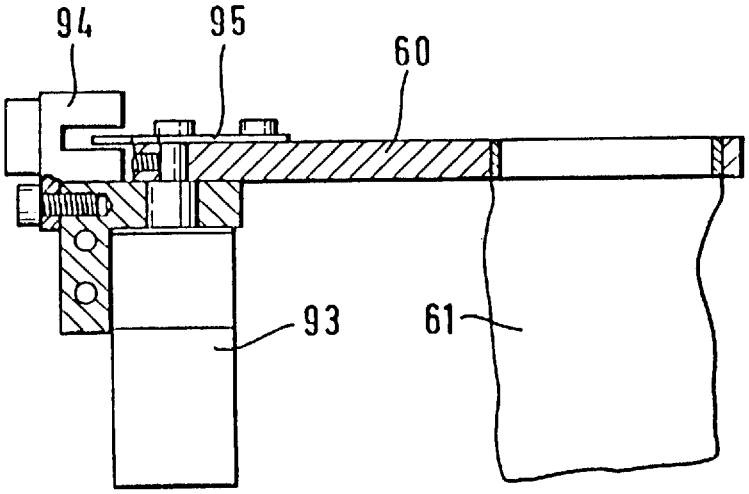
FIG. 8A is a side cross section of a receptacle for removed caps.
Figure 8B:
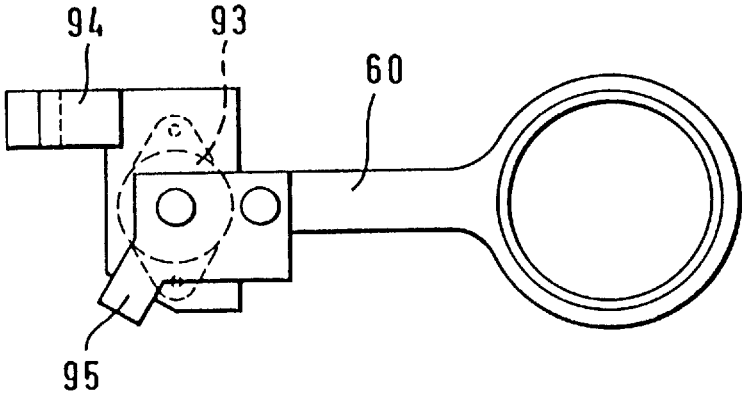
FIG. 8B is a top plan view of the receptacle for removed caps.

FIG. 8 shows another improvement of the device of the invention to dispose of removed caps in a simple and contamination-free manner. At its one side, lever (60) is rigidly connected to the axis of a motor (93) and can be swung out with the aid of said motor. On its other side, the lever is provided with a annular opening into which a tube (61) ends. A flag (95) which can be detected by light barriers (94) is also connected to the lever.

The receptacle functions in such a manner that when a cap is twisted off from the vessel, the annular opening of the lever is moved underneath the cup holding device (10); the cap holding device then releases the cap such that said cap falls through the annular opening of the lever into tube (61). After this procedure, lever (60) is moved out of the area of the cap holding device so as to not interfere with successive operating steps. The lever must, hence, assume at least two positions; the first position is one underneath the cap holding device while the second one is outside this area. Light barriers are used for proper recognition of these positions.

Tube (61) of the receptacle can be made of a plastic or a woven material. The tube should be dimensioned such that the caps sliding through it arrive in a receiving zone where they do not interfere with the proper functioning of the device and do not cause contamination.

List of reference numerals

(10) Cap holding device
(11) First plate
(12) Second plate
(13) Drive motor
(14) Gripping jaws
(15) Axis
(16) Recess
(17) Pin
(18) Toothed area
(20) Moving device
(21) Screw
(22) Nut
(23) Drive motor
(24) Catch
(30) Cap
(40) Arrangement with two vessel holders
(41, 41') Clamping jaws
(42, 42') Adjusting elements
(43, 43') Spindle
(44, 44') Drive motor
(45) Rotating arm
(46) Axis of the clamping jaws (41, 41')
(47) Axis of the rotating arm (45)
(50) Left leg
(51) Right leg
(52) Conveyer belt
(53) Grab
(54) Vessel holding elements
(55) Nut
(56) Tappet
(57) Toothed belt
(58) Motor
(60) Lever
(61) Tube
(70) Pin
(71) Ball bearing
(72) Lifting magnet
(73) Motor
(74) First toothed wheel
(75) Second toothed wheel
(80) Motor
(81) Damping element
(82) Drive axis for toothed wheels
(90) Gripping jaws
(91) Threaded rod
(92) Motor
(93) Motor
(94) Light barrier
(95) Flag

We claim:

1. A device for removing caps from vessels, said device comprising:

first vessel holding means for holding a first vessel therein;

a cap holding means adjacent said first vessel holding means, said cap holding means including holding elements for holding a cap of the first vessel;

moving means coupled to said cap holding means for moving the cap holding means in a direction which is parallel to an axis of the first vessel, and for rotating the cap holding means around the axis of the first vessel wherein said moving means comprises a threaded rod attached to said cap holding means, said threaded rod being engaged in a rotatable nut; said device further comprising holding means for selectively holding the rotatable nut, thereby selectively preventing the rotatable nut from rotating, thereby enabling selective conversion of a rotation of the threaded rod into linear movement of the cap holding means.

2. A device as recited in claim 1, wherein an outer circumference of the rotatable nut includes indentations thereupon, and wherein said holding means comprises a tappet which is selectively activated to engage the indentations.

3. A device as recited in claim 1, further comprising cap receptacle means for receiving removed caps therein, said cap receptacle means including a movable lever with a cap receiver attached thereto, said movable lever being movable from a first position below the cap holding means whereby caps held by the cap holding means are received in the cap receiver, and a second position away from the cap holding means.

4. A device as recited in claim 3, wherein said cap receiver comprises an elastic tube.

5. A device as recited in claim 1, wherein the holding elements of the cap holding means comprise at least two clamping jaws having a space therebetween, each of said at least two clamping jaws being movable from a first position to a second position by a drive means, wherein the space between the at least two clamping jaws when the clamping jaws are in the first position is larger than a diameter of the cap whereby the cap can be disposed in the space, and wherein, when the at least two clamping jaws are moved to the second position, the at least two clamping jaws engage an outer circumference of the cap.

6. A device as recited in claim 5, wherein the drive means for moving the at least two clamping jaws comprises a first plate and a second plate, said first and second plates being disposed around a common axis, said drive means comprising a rotating means to rotate the first plate relative to the second plate, and wherein each of said at least two clamping jaws is rotatably connected to the first plate, and wherein each of the clamping jaws is coupled to the second plate by pins.

7. A device as recited in claim 5, wherein the cap holding means comprises at least four clamping jaws.

8. A device as recited in claim 6, wherein the cap holding means comprises at least four clamping jaws.

9. A device as recited in claim 5, wherein said cap holding means includes a maximum of eight clamping jaws.

10. A device as recited in claim 6, wherein said cap holding means includes a maximum of eight clamping jaws.

11. A device as recited in claim 5, wherein an edge of each of the clamping jaws includes a toothed portion thereupon, said toothed portion for engaging the cap.

12. A device as recited in claim 11, wherein each toothed portion comprises a plurality of individual teeth, with the individual teeth decreasing in size from a first side of the edge to a second side of the edge.

13. A device as recited in claim 5, wherein each of said at least two clamping jaws include spikes which engage the cap.

14. A device as recited in claim 5, wherein each of said at least two clamping jaws include needles which engage the cap.

15. A device as recited in claim 1, wherein said moving means is configured to linearly move the cap holding means along the axis of the first vessel, and to simultaneously rotate the cap holding means around the axis of the first vessel.

16. A device as recited in claim 1, wherein said moving means comprises a threaded rod rotatably driven by a motor, said threaded rod engaging a stationary thread wherein rotational movement of the threaded rod by the motor is converted into linear motion, thereby linearly and rotatingly moving the cap holding means.

17. A device as recited in claim 1, wherein the first vessel holding means comprises at least two vessel holding jaws configured to engage the first vessel in a space therebetween, said at least two vessel holding jaws being movable with respect to each other to increase and decrease the space therebetween.

18. A device as recited in claim 17, wherein the vessel holding jaws are tiltable with respect to the axis of the vessel.

19. A device as recited in claim 1, further comprising a conveyor belt disposed adjacent said vessel holding means, for transporting a plurality of vessels including the first and second vessels to a position beneath the first vessel holder in a successive manner.

20. A device as recited in claim 1, wherein said first vessel held in said first vessel holding means is a sample vessel.

21. A device for removing caps from vessels, said device comprising:

first vessel holding means for holding a first vessel therein;

a cap holding means adjacent said first vessel holding means, said cap holding means including holding elements for holding a cap of the first vessel;

moving means coupled to said cap holding means for moving the cap holding means in a direction which is parallel to an axis of the first vessel, and for rotating the cap holding means around the axis of the first vessel, wherein the holding elements of the cap holding means comprise at least two clamping jaws having a space therebetween, each of said at least two clamping jaws being movable from a first position to a second position by a drive means, wherein the space between the at least two clamping jaws when the clamping jaws are in the first position is larger than a diameter of the cap whereby the cap can be disposed in the space, and wherein, when the at least two clamping jaws are moved to the second position, the at least two clamping jaws engage an outer circumference of the cap, wherein an edge of each of the clamping jaws includes a toothed portion thereupon, said toothed portion for engaging the cap, and wherein each toothed portion comprises a plurality of individual teeth, with the individual teeth decreasing in size from a first side of the edge to a second side of the edge.

22. A device for removing caps from vessels, said device comprising:

first vessel holding means for holding a first vessel therein;

a cap holding means adjacent said first vessel holding means, said cap holding means including holding elements for holding a cap of the first vessel;

moving means coupled to said cap holding means for moving the cap holding means in a direction which is parallel to an axis of the first vessel, and for rotating the cap holding means around the axis of the first vessel; and a second vessel holding means configured to move at least the first vessel and a second vessel with respect to said cap holding means, such that when the first vessel holding means is disposed below the cap holding means, the second vessel holding means is disposed to receive the second vessel therebetween, and wherein the first and second vessel holding means can be moved through movement of a common rotating arm, thereby moving the first and second vessels relative to said cap holding means.

23. A device for removing caps from vessels, said device comprising:

first vessel holding means for holding a first vessel therein;

a cap holding means adjacent said first vessel holding means, said cap holding means including holding elements for holding a cap of the first vessel;

moving means coupled to said cap holding means for moving the cap holding means in a direction which is parallel to an axis of the first vessel, and for rotating the cap holding means around the axis of the first vessel; and a grabbing means for grabbing and moving the first vessel from a rack to the first vessel holding means.

24. A method for removing caps from vessels, said method comprising the steps of:

holding a vessel in a vessel holder;

holding a cap of the vessel in a cap holding device;

linearly and rotatingly moving the cap holding device through actuation of a moving means, thereby removing the cap from the vessel, wherein said step of pulling the vessel from a rack comprises steps of engaging the vessel with a grabbing means at a first pressure;

relieving the first pressure and moving the grabbing means in a direction whereby the grabbing means engages the vessel and an upper portion thereof, under an upper edge thereof.

25. A method as recited in claim 24, comprising a first step of pulling a vessel from a rack with a holding means, then introducing the cap into the cap holding means.

26. A method as recited in claim 24, wherein said step of holding a vessel in a vessel holder comprises holding a sample vessel in the vessel holder.

27. A method as recited in claim 24, comprising a first step of moving a rack of vessels underneath the vessel holding means with a conveyor belt, wherein the vessels in the rack are successively disposed under the vessel holding means.

* * * * *